United States Patent [19]

Otterson

[11] 4,241,856

[45] Dec. 30, 1980

[54] CHILD-RESISTANT FLUID TOP

[75] Inventor: Lewis L. Otterson, Chagrin Falls, Ohio

[73] Assignee: Weatherchem Corporation, Twinsburg, Ohio

[21] Appl. No.: 12,835

[22] Filed: Feb. 16, 1979

[51] Int. Cl.[3] ..... B65D 25/50; B67D 3/00

[52] U.S. Cl. ..... 222/539; 215/221; 220/85 SP

[58] Field of Search ..... 222/530, 539; 220/85 SP; 215/209, 216–221

[56] References Cited

U.S. PATENT DOCUMENTS

| | | | |
|---|---|---|---|
| 2,947,453 | 8/1960 | Parish et al. | 222/539 |
| 3,134,522 | 5/1964 | Shwisha | 222/539 |
| 3,233,769 | 2/1966 | Jessop | 215/217 X |
| 3,884,379 | 5/1975 | Landen | 215/221 |
| 3,892,326 | 7/1975 | Schneible | 215/221 |
| 3,902,620 | 9/1975 | McIntosh | 215/209 |
| 3,958,709 | 5/1976 | Nixdorff | 215/221 |
| 4,099,639 | 7/1978 | Boxer et al. | 215/216 X |

FOREIGN PATENT DOCUMENTS

| | | | |
|---|---|---|---|
| 1181120 | 11/1964 | Fed. Rep. of Germany | 222/539 |

*Primary Examiner*—F. J. Bartuska

*Attorney, Agent, or Firm*—Pearne, Gordon, Sessions, McCoy & Granger

[57] ABSTRACT

A closure assembly for a container with a reversible spout for dispensing or storage and having easily manipulated finger grips for assembly and disassembly and releasable locking tabs for resisting disassembly by children. The dispensing spout includes a special base configuration which allows the locking tabs to be effective in resisting disassembly in either position of the spout. Integral lip seal structure affords a positive sealing of relevant elements.

8 Claims, 8 Drawing Figures

Fig. 1
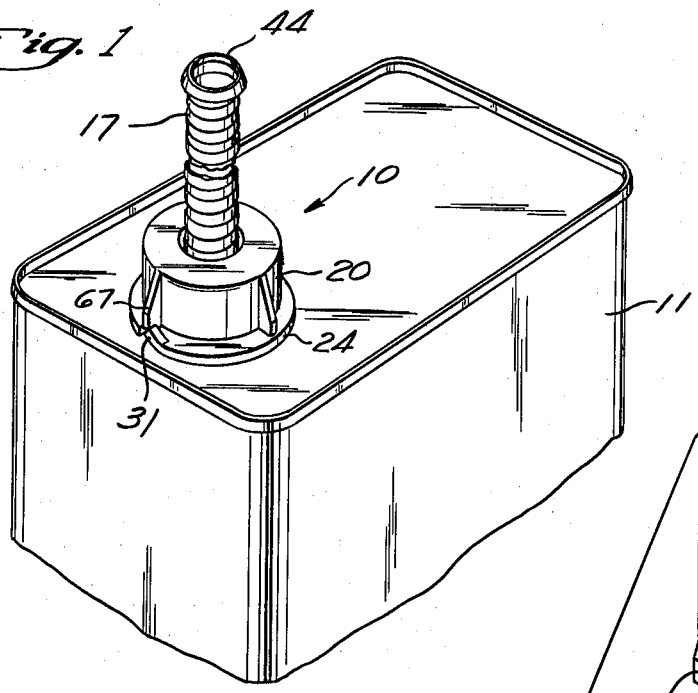
Fig. 2
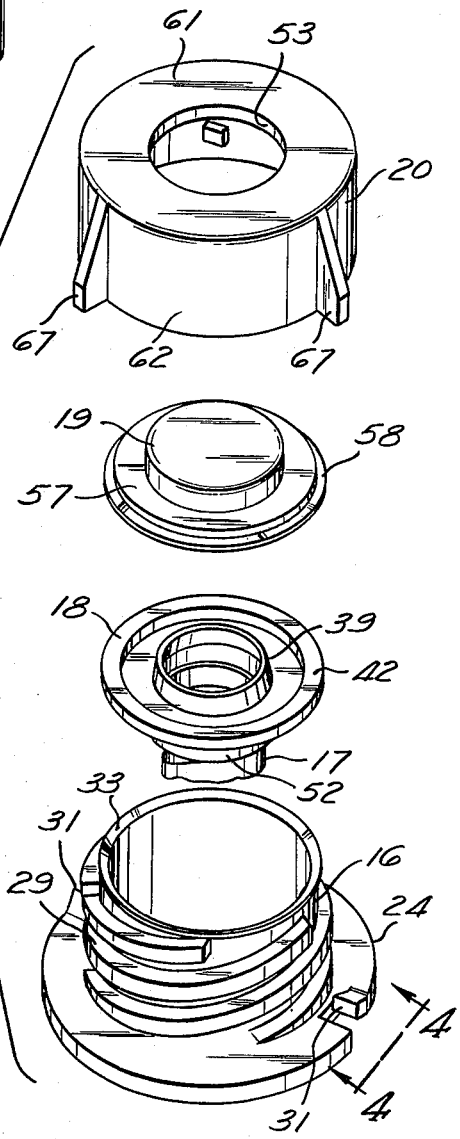
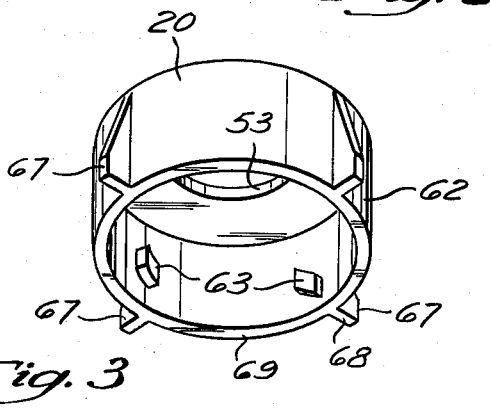
Fig. 3
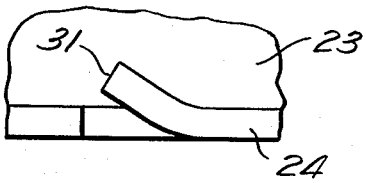
Fig. 4

Fig. 5
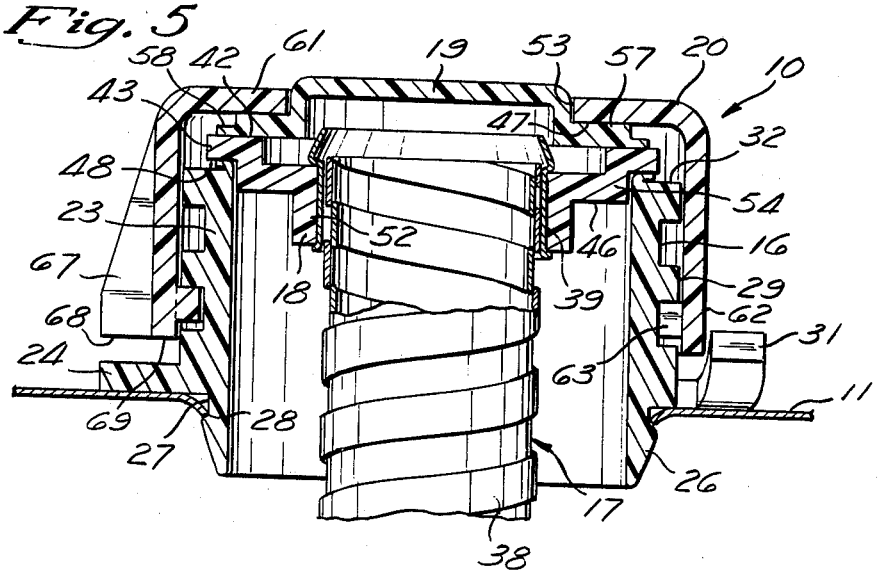
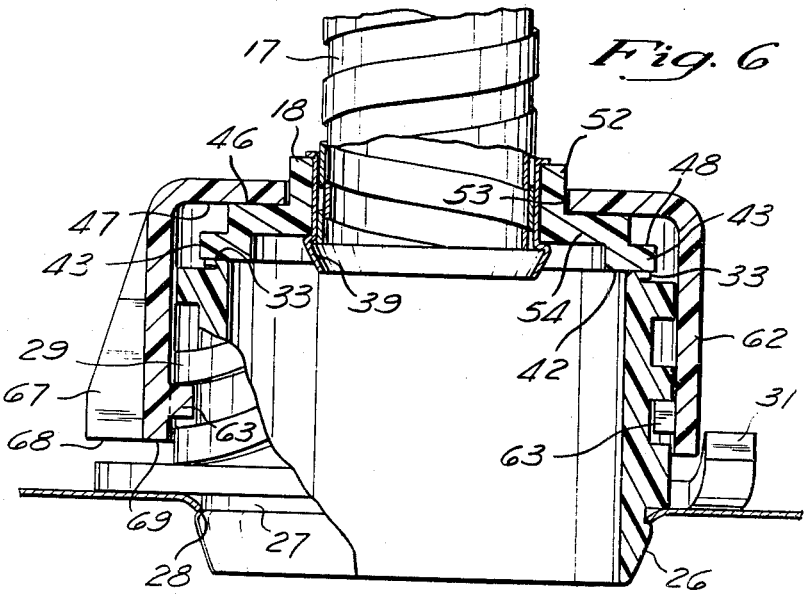
Fig. 6
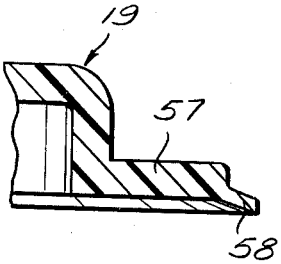
Fig. 7
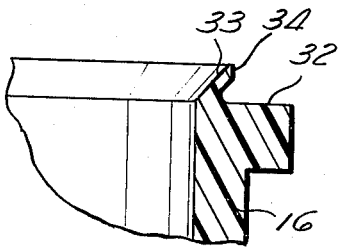
Fig. 8

CHILD-RESISTANT FLUID TOP

BACKGROUND OF THE INVENTION

The invention relates to closures for fluid containers, and in particular to a safety locking closure assembly resistant to unauthorized opening by a child.

PRIOR ART

Self-locking closures for discouraging unauthorized tampering with the contents of a container have gained wide acceptance, particularly in consumer-purchased pharmaceutical containers. Self-locking closures for containing fluids present more difficult problems as compared to the containment of solids in terms of closure sealing effectiveness, reliability, and convenience to the user. More specifically, it is difficult to economically mass-produce closure elements with such a high degree of dimensional precision and consistency of physical properties that adequate fluid tight stoppage and self-locking capability will repeatedly be achieved. U.S. Pat. Nos. 3,884,379 to Landen, 3,892,326 to Schneible, and 3,958,709 to Nixdorff are examples of proposed closure structures directed to certain of the problems under consideration here.

SUMMARY OF THE INVENTION

The invention provides a screw thread cap closure assembly having self-latching elements making it child-resistant but relatively convenient for an adult user. The latching elements comprise a pair of diametrically opposite finger grips defining the major diameter of a threaded cap retainer and a pair of locking tabs arranged to cooperate with the finger grips. Once closed, the retainer can be released only by manual deflection of both tabs and simultaneous turning of the retainer in a reverse direction. The retainer is reinstalled by simply twisting the retainer in an opposite direction until fully engaged by the locking tabs.

The closure parts include a lip seal arrangement with a relatively high axial deflection capacity. This deflection capacity assures a positive closure seal regardless of variations in tightening forces applied by the user, dimensional tolerances in manufacture, temperature and other conditions. Satisfactory tightening is self-indicated by the assembly when the locking tabs are felt to take hold. Problems associated with overtightening or undertightening are thereby substantially eliminated.

As disclosed, various elements of the closure assembly are particularly suited for use with a storeable spout. In a generally conventional manner, the spout is inverted and is stored within a fluid container during periods of non-use. When it is desired to pour a fluid or otherwise dispense materials from the container, the spout is withdrawn and assembled in a generally upright position. The retainer in both positions of the spout is effective to releasably lock the various assembly parts in fluid-tight relation.

The ease with which an adult can manipulate the retainer, once educated to the requisite steps of unsecuring it as well as locking it, is an important factor in encouraging the user to take advantage of its safety features. This convenience, or, conversely, the avoidance of excessive physical effort and complicated procedures with overly sensitive elements, is of particular advantage where, as disclosed, the retainer is intended to be removed and reinstalled both before and after dispensing through the spout for a total of four separate steps of locking or unlocking the retainer.

In the disclosed embodiment, the spout is closed by a sealing plug when the assembly is arranged in a storage mode. Alternatively, with the assembly in a dispensing mode, the sealing plug is removed. A base of the spout is provided with a stepped configuration which affords two levels of effective thickness such that the missing thickness of the sealing cap in the dispensing mode is accounted for by the spout base. Maintenance of a constant effective thickness allows the retainer to operate in substantially the same manner in both the storage and dispensing modes.

BRIEF DESCRIPTION OF THE DRAWINGS

FIG. 1 is a fragmentary, perspective view of a fluid container incorporating a closure assembly constructed in accordance with the invention;

FIG. 2 is an exploded, perspective view of the closure assembly;

FIG. 3 is a perspective view of a bottom side of a retainer of the closure assembly;

FIG. 4 is an enlarged, fragmentary view of one of two locking tabs taken along the line 4—4 in FIG. 2;

FIG. 5 is an enlarged, cross sectional view of the closure assembly in a storage mode;

FIG. 6 is a view similar to FIG. 5 but with the assembly in a dispensing mode;

FIG. 7 is an enlarged, fragmentary, cross sectional view of a seal cap of the assembly illustrating an integral seal in an unstressed state; and FIG. 8 is an enlarged, fragmentary, cross sectional view of a neck of the closure assembly illustrating an integral seal in an unstressed state.

DESCRIPTION OF THE PREFERRED EMBODIMENT

Referring now to the drawings, there is illustrated a closure assembly 10 provided on a fluid container in the form of a sheet metal can 11. The container 11 is constructed in a conventional manner and may be used for merchandising liquids contained therein and/or as a reusable container for storage, transport, and dispensing of fluids or other pourable materials. A common example of the latter category of use is a container for gasoline or other liquids which are ordinarily transferred from the container to another storage vessel, such as a fuel tank on a motor vehicle or the like.

The principal parts of the closure assembly 10 include a neck 16, a spout 17 with a base 18, a seal cap 19, and a retainer 20. These parts, including the spout base 18 but excluding the spout 17 itself, are preferably injection-molded of polyethylene or like plastic material. The main body of the neck 16 is a cylindrical tube 23 having an integral flange 24 extending radially outwardly from the neck body adjacent a lower end 26 of the neck body. The outer surface of the lower neck end 26 is tapered with increasing diameter in a direction toward the flange 24. An undercut area or groove 27 is disposed axially between the flange 24 and tapered lower end 26. The neck 16 is permanently secured to the container by forcing its lower end 26 into a circular hole 28 in the container until the edge of the hole snaps into the groove 27. The outside diameter of the neck body is formed with male screw threads 29.

At diametrically opposite points on the flange 24 are a pair of integrally formed locking tabs 31, which are inclined upwardly (FIG. 4) out of the plane of the flange 24. At its upper end face 32, the neck 16 includes an integral lip seal 33 having a relatively thin wall in comparison to the nominal wall thickness of the neck body and having a circumferential free edge 34 capable of deflecting axially relative to the adjacent neck end face 32.

The spout 17 is a subassembly of a flexible steel conduit, of known construction, permanently assembled at one end to the base 18 by means of a swaged metal collar 39. The spout base 18 is a circular element having an inside diameter dimensioned to closely receive and support the collar 39. The base 18 has a stepped profile in cross section (FIGS. 5, 6). In a dispensing or pouring mode (FIG. 6) where the spout 17 extends from the container, an annular surface 42 on an outer flange 43 of the base 18, facing upstream with respect to dispensing flow through the spout, is seated against the neck seal 33. As used herein, the terms "upstream" and "downstream" are made with respect to directions relative to dispensing flow through the length of the spout 17, i.e., from the base 18 to a free end 44 of the spout. Another radially extending annular surface 46 facing downstream engages an underside 47 of the retainer 20.

In a storage mode (FIG. 5) where the spout 17 is inverted and disposed in the container 11, the surface 42 is abutted against the seal 19 while an annular surface 48 radially outward of the earlier-mentioned annular surface 46 abuts the neck seal 33. These downstream facing annular surfaces 46, 48 are axially spaced from one another a predetermined distance for reasons set out below.

An axial extension 52 of the spout base 18 is dimensioned to fit through a central aperture 53 in the retainer 20. An intermediate portion 54 of the spout base 18 has an outside diameter slightly less than the inside diameter of the neck 16 so that in the storage mode of FIG. 5 a major portion of the spout base 18 is receivable within the neck and is centered therewith.

The seal cap 19 is an imperforate, circular element having a bowl-shaped configuration, including a peripheral flange 57. As indicated in FIG. 7, this peripheral flange 57 includes an integral lip seal 58. The seal 58 has a thickness substantially less than that of the cap flange 57 and is adapted to be resiliently axially deflected from the unstressed conical configuration of FIG. 7 to the relatively flat shape assumed in the storage mode of FIG. 5. The outside diameter of a main dish portion of the seal cap is slightly smaller than the retainer aperture 53, thereby enabling this portion to nest in the aperture and be centered by it over the spout base 18.

The main body of the retainer 20 is generally cup-shaped, and is defined by a generally radial end face 61 surrounding its aperture 53 and a cylindrical skirt 62 depending from the periphery of the end face and sized to extend over the neck 16. A plurality of lugs 63 extending radially inwardly from the interior wall of the retainer skirt 62 engage, as female threads, with the neck threads 29. Two sets of diametrically opposite finger grips 67 equally spaced about the outer circumference of the retainer skirt 62 extend outwardly from the skirt in generally radial planes. Lower edges 68 of the finger grips 67 are generally coplanar with a lower face 69 of the retainer skirt 62 and extend radially outward at least to the radius of the locking tabs 31 on the neck flange 24.

In a manner now to be described, the finger grips 67 cooperate with the locking tabs 31 to provide an assembly which is resistant to unauthorized juvenile attempts to open the assembly. When the retainer 20 is turned onto the neck 16, in a clockwise or righthand direction in the illustrated case, the finger grips 67 sweep arcuately over the locking tabs 31 and eventually resiliently deflect these tabs axially downwardly toward the plane of the associated flange 24. The various parts of the assembly are dimensioned such that in both storage and dispensing modes (FIGS. 5 and 6, respectively) the operative sealing surfaces are adequately and reliably compressed by screw action of the retainer 20 when the pair of finger grips 67 just pass respective ones of the locking tabs 31. At this point, the locking tabs 31 snap back from their deflected positions into the path of the finger grips 67, thereby releasably preventing the retainer 20 from reversing direction and uncoupling from the neck.

A combination of increased resistance to further turning of the retainer, due to effective flattening of one or both of the seals 33, 58, depending on the assembly mode, as discussed below, and snapping effect of the locking tabs 31, provides a signal to the user that installation of the retainer 20 is complete. The risk of overtightening the assembly is thereby reduced.

In order to release the retainer 20 from the neck 16, to change from one assembly mode to the other, each of the locking tabs 31 must be deflected simultaneously out of the path of the finger grips 67 while the retainer 20 is unscrewed, i.e. turned, counterclockwise. This requires levels of understanding, mechanical aptitude, and finger dexterity and coordination ordinarily not yet achieved by children too young to comprehend the dangers of use or misuse of or exposure to material carried in the container 11.

The disclosed arrangement of the diametrically opposed finger grips 67 at the radially outer extremities of the retainer 20 affords a structure which minimizes the finger pressure required for turning the retainer on or off the neck 16. This convenience encourages return of the assembly to its fluid confining storage mode (FIG. 5) after each period of partial dispensing or disassembly for purposes of filling the container through the neck 16.

In accordance with the invention, the geometry of the members retained on the neck 16, the spout base 18, and seal cap 19 is such that the locking tabs 31 are equally effective on the retainer 20 in both assembly modes. This result is achieved by the stepped profile of the retainer base 20. In particular, the axial displacement of the planes of the upstream surface 42 and the radially inward downstream surface 46 is approximtely equal to the combined thickness of the outer base flange 43 and the seal cap flange 57. The significance of this dimensioning may be comprehended by comparison of FIGS. 5 and 6, where in both instances the final axial, and therefore angular, position of the retainer 20 with respect to the neck 16 is essentially the same even though the seal cap 19 is omitted from the assembly in the dispensing mode of FIG. 6.

The reliability of the closure formed by the assembly 10 is greatly enhanced by the conical lip seals 33 and 58 on the spout base 18 and seal cap 19. These seals 33 and 58 are effective in containing fluids through a relatively large range of axial deflection or compression falling short of complete flattening. With the various parts being nominally dimensioned such that the locking tabs 31 catch the finger grips 67 short of full flattening of the seals, normally expected size variations in the manufactured parts, or temperature effects, are not detrimental to a reliable seal.

Although a preferred embodiment of this invention is illustrated, it should be understood that various modifications and rearrangements of parts may be resorted to without departing from the scope of the invention disclosed and claimed herein. For example, the neck can be made as an integral part of a molded container.

What is claimed is:

1. A container closure for fluids comprising a hollow neck, a spout for dispensing fluid from the neck, a cap for closing said neck during storage of the container and its contents, an apertured retainer threadable onto the neck for alternatively retaining the spout and cap or the spout on the neck, the spout having a radial flange dimensioned to prevent its passage through the aperture of said cap, said cap being sufficiently large to close said aperture, the aforementioned elements being constructed and arranged such that in a storage condition the flange and cap are successively assembled on the neck and held thereon by the retainer and in a dispensing condition the flange is assembled on the neck without the cap and held thereon by the retainer, the neck having a central passage of a size sufficient to receive a dispensing end of the spout thereon for storage, means for releasably locking the retainer on the neck by preventing unthreading of the retainer from the neck, said retainer being arranged to be locked on the neck by said locking means in both storage and dispensing conditions of the spout, said spout including a base which provides said flange, said base having a stepped exterior profile including a plurality of axially spaced radial surfaces including surfaces of said flange, the axial spacing between said spaced radial surfaces being related to the effective axial thickness of said cap measured by said retainer whereby the absence of said cap is accounted for by an end-for-end reversal of the spout on the neck such that said retainer adequately axially tightens the elements assembled on said neck while indexing to the same angular and axial position with respect to said neck and said locking means in both storage and dispensing conditions of said spout.

2. A container closure as set forth in claim 1 wherein said spout base includes a first cylindrical portion dimensioned to fit within said neck with a limited clearance whereby said spout is centered on said neck by cooperation between said cylindrical portion and said neck.

3. A container closure as set forth in claim 2, wherein said spout base includes a second cylindrical portion dimensioned to fit the aperture of said retainer, said retainer aperture being radially centrally disposed relative to said neck when assembled thereon whereby said spout is centered in said neck.

4. A spout assembly for dispensing liquids and other pourable material from a container comprisng a hollow neck, a spout, a cap, and a retainer, said spout being reversible on said neck such that in a dispensing mode said spout forms an external extension of said neck and in a storage mode said spout extends into said neck and container, said spout having a pair of oppositely facing radial surfaces, said neck having an end face arranged to support the spout through one of said radial spout faces when said spout is in a dispensing mode, said cap including a generally radial surface adapted to close said spout when said spout is in said storage mode, said spout being supported on said neck through the other of said radial spout surfaces when in said storage mode, said retainer and neck including complementary elements for permitting said retainer to be threaded onto said neck, means on said neck for releasably locking said retainer in threaded engagement with said neck in both the storage and the dispensing modes of said spout, said retainer being arranged to compress and thereby maintain said spout on said neck and said cap over said spout when said spout is in its storage mode and to compress and thereby maintain said spout on said neck without said cap when said spout is in its dispensing mode, at least one of said neck, cap and spout members including an integral lip seal for sealingly contacting another of such members during assembly into one of said modes, said lip seal being arranged to deflect a relatively large axial distance under compression by said retainer whereby liquid sealing contact by said lip seal is developed and maintained despite dimensional variations in said assembly and tightening torque variations on said retainer when said retainer is locked on said neck by said locking means.

5. A spout assembly as set forth in claim 4, wherein said neck, spout and cap members include a second lip seal, said first lip seal being disposed at an annular zone of contact between said neck and spout, said second lip seal being disposed at an annular zone of contact between said spout and cap.

6. A spout assembly as set forth in claim 4, wherein said lip seal is integrally formed with said neck, said lip seal being arranged to alternatively seal both of said radial spout surfaces depending on the assembly mode of said spout.

7. A spout assembly as set forth in claim 4 wherein said cap includes a second lip seal arranged to seal against said one radial spout surface when said spout is in a storage mode.

8. A spout assembly as set forth in claim 4, wherein said spout and cap are constructed and arranged with respect to said retainer to be retained in their respective storage positions by axial compressive forces developed substantially exclusively through said lip seal.

* * * * *